US005370063A

United States Patent [19]

Childers

[11] Patent Number: 5,370,063

[45] Date of Patent: Dec. 6, 1994

[54] NON-BINDING CANTILEVERED TABLE LIFTING DEVICE

[76] Inventor: C. Lee Childers, 511 Wynfield Trace, Norcross, Ga. 30092

[21] Appl. No.: 24,653

[22] Filed: Mar. 1, 1993

[51] Int. Cl.[5] ..... A47B 11/00

[52] U.S. Cl. ..... 108/147; 108/143

[58] Field of Search ..... 108/145, 147, 144, 146

[56] References Cited

U.S. PATENT DOCUMENTS

| | | | |
|---|---|---|---|
| 3,140,559 | 7/1964 | Grow et al. | 108/147 |
| 3,273,517 | 9/1966 | Amthor et al. | 108/147 |
| 4,850,563 | 7/1989 | Grout | 108/147 |
| 4,981,085 | 1/1991 | Watt | 108/147 |
| 5,199,778 | 4/1993 | Aoki et al. | 108/147 |

*Primary Examiner*—Kenneth J. Dorner
*Assistant Examiner*—Gerald A. Anderson
*Attorney, Agent, or Firm*—Roy P. Collins

[57] ABSTRACT

A motor driven vertically adjustable work surface or desk which is optimized to support a substantial load of equipment cantilevered toward the front of the surface. The work surface is supported by a pair of motor driven telescoping legs having internal rolling bearings and rack and pinion drive arranged to eliminate sliding friction and maintain smooth motion. The telescoping legs are mounted toward the rear of the work surface and supported on a base or wall so as to provide maximum clearance under the front of the desk to accommodate wheelchairs and the like.

12 Claims, 8 Drawing Sheets

NON-BINDING CANTILEVERED TABLE LIFTING DEVICE

BACKGROUND OF THE INVENTION

1. Field of the Invention

The present invention relates to the field of motor powered mounting bases and pedestals for supporting and controllably raising and lowering work tables, equipment benches, and the like.

2. Description of the Related Art

There are numerous occasions on which it is desirable to precisely position a working surface (e.g. table top) or equipment mount to facilitate worker access or alignment of equipment to a related operation. A common example is the need to elevate a table or desk top an appropriate height before seated workers, each of which might have different optimum working levels. Such is the case of a keyboard operator using a computer or data terminal, and it is currently well known that operating such equipment for extended periods at improper height can lead to chronic maladies such as eyestrain, back distress, wrist/hand disorders, etc. These problems can often be relieved by the worker adjusting the height of the work surface to a level appropriate for his particular body proportions. Moreover, occasional change in level can also be beneficial to relieve fatigue and temporary discomfort.

Because a desk top is often laden with heavy computer equipment, books, etc. it is desirable that the vertical adjustment of such a system be smoothly powered by a motor rather than manually. Further a properly arranged electric or hydraulic drive can provide a smooth adjustment of height to virtually any desired precision.

With recent widespread accommodation of handicapped workers into factories and offices, such adjustable work platforms are even more desirable. Workers who are in wheelchairs for example cannot readily move from their wheelchair to another work stool or chair of optimum height, and therefore need to be able to adjust the work surface to the proper height for them to work from their own wheelchair. A precisely controllable powered lifting system is of particular advantage to many handicapped workers who have less than normal strength in their upper bodies.

Powered lifting bases for work surfaces have been provided in the past, but it is common for these to have single or dual supports centrally disposed under the work surface. Such designs, either hydraulically, screw, or gear driven minimize off-set loading, distortion, and binding of the lifting mechanism, but at the expense of blockage of the space under the work surface. Such arrangements are particularly objectionable for workers in wheelchairs, because of the somewhat larger clear space required to accommodate the wheelchair, legs, and feet of the handicapped worker, and the limited ability of such a worker to easily adjust to interference of the blocking pedestals, legs, and cross members of such devices.

Recently desktops have evolved to shapes other than the traditional rectangle. It is not uncommon to encounter L-shaped surfaces as computer work tables which are situated in the corner of an integrated office furniture system/cubicle. The elongated feet under the legs of such systems are normally parallel in a direction running perpendicular to the front edge of the work top, or they are arranged to run perpendicular to the back walls such that they toe-in towards the front of the work top. In either case, the front tips of the elongated feet are forced to be as close together as the foreshortened front edge of such a corner work top, and therefore they create an even narrower space within which to fit a wheelchair.

While these problems and objections could be overcome by moving the vertical supporting legs close to the rear of the work top and arranging the feet to align with the back corner walls at an angle opening toward the front edge of the top, designs based on the prior art do not have the geometry, rigidity, stability, or lack of binding sufficient to be so arranged. What is needed and what has not yet been provided by the prior art is a table lifting device having vertical supporting legs of sufficient stiffness to be positioned near the back of the work top, having internal bearings such that the vertical driving mechanism can operate smoothly without binding under the offset load on the work top which will necessarily be cantilevered toward the front of the top and thereby create substantial bending moments in the legs, and having feet spreading at an angle opening toward the front of the work top to provide maximum clear space under the work top to accommodate a wheelchair, workers legs and feet, etc.

SUMMARY OF THE INVENTION

The present invention provides a motor driven vertically adjustable work surface or desk which is optimized to support a substantial lead of equipment cantilevered toward the front of the surface, with supporting legs near the back of the surface such that a maximum of unobstructed space is provided beneath the work surface. A top of traditional rectangular or other convenient shape is firmly attached to the upper ends of two vertical telescoping leg assemblies which in turn are supported by attachment at their lower ends to a base which rests upon the floor, or are attached to a wall. The base may be either a single unit of appropriate shape, or a pair of separate feet, each attached to one of the legs. In the preferred embodiment, the single base is a rigid, fiat unit having elongate sides joined near the back at an angle opening toward the front such that the floor space between the sides toward the front is unobstructed, and such that the sides fit closely against the adjoining walls in a corner. The telescoping legs are of mirror image construction, and each comprises an outer tubular member encompassing a rectangular interior space in which an inner member slidably moves. The inner member is of a rectangular construction. This inner member is attached to the underside of the top, and is driven up and down within the outer tubular member by a motor driven pinion engaging a rack which is attached to the front surface of the inner member. The drive shaft on which the pinion is mounted is supported in bushings in the inside and outside walls of the outer tubular member. The outer tubular members of the legs are rigidly joined by a horizontal beam attached to their inside walls which runs between them, and on which the single drive motor is mounted. In the preferred embodiment the horizontal beam is of a rigid box construction and the drive motor is mounted inside the space enclosed within the box beam. The rotary output of the single drive motor is transmitted to the drive pinion in each telescoping leg through drive shafts which are also enclosed within the box beam running between the legs. In the preferred embodiment, the motor drives the single input shaft of a reduction gear box having two output shafts, each of which is connected through the above mentioned drive shafts to the drive pinions in each leg.

An important feature of the present invention is means to resist the considerable moment created by the load which is cantilevered well out in front of the axes of the legs, and the resulting tendency to bind the inner member within the outer tubular member. In the preferred embodiment this is accomplished by providing in each leg a first rolling bearing mounted to the back of the lower end of the inner member which rolls against the rear inside wall of the outer tubular member, and a second rolling bearing mounted adjacent to the pinion, having a diameter larger than the pinion such that it rolls against the front surface of the inner member adjacent to the rack. The teeth of the pinion acting against the teeth of the rack provide the vertical force to support the vertical force of the load on the top. The vertical force on the top acting at a distance from the axis of the pinion creates a moment which is resisted by a horizontal force acting against the first rolling bearing at the lower end of the inner member acting at its distance below the axis of the pinion. The magnitude of this horizontal force increases as the inner member is elevated, and it must be resisted by a corresponding horizontal force acting on the front side of the inner member. This reacting horizontal force is provided by the second rolling bearing which is mounted adjacent to the pinion and which rolls on the front surface of the inner member adjacent to the rack. Without this second rolling bearing, the reacting horizontal force would have to be provided by the pinion driving further into the teeth of the rack. Such action would increase the depth of engagement to an inappropriate degree and cause binding, distortion, and excessive wear of the pinion and rack. It is a principal function of the second rolling bearing adjacent to the pinion to support the moment created by the cantilevered load and prevent binding of the pinion into the rack, thereby assuring smooth vertical movement of the inner member.

In the preferred embodiment additional rolling bearings are also compliantly mounted to the front of the lower end of the inner member and the rear of the top of the outer tubular member. The upper rolling bearing is mounted to the outer tubular member by a bolt or self-locking nut on a stud and compression springs which compliantly urge the upper rolling bearing against the rear surface of the inner member. The nut may be adjusted to preload the compression springs to provide adequate force of the rolling bearing against the inner member. In the preferred embodiment the compression spring comprises two or more Belleville spring washers concentrically mounted on the mounting bolt. Similarly, the lower roller is also compliantly mounted to the front of the lower end of the inner member such that it rolls against the inside front surface of the outer tubular member. This rolling bearing is also mounted in a fashion similar to that of the upper rolling bearing such that it is urged against the outer tubular member by a compression spring, which preferably comprises two or more Belleville washers concentric to its mounting bolt. The action of these two additional rolling bearings is to eliminate excess clearance between the inner and outer members and the resulting shake by compliantly urging both front and rear rolling bearings into constant contact with their respective bearing surfaces, while elastically compensating for normal variations in the dimensions of the inner and outer members. In alternative embodiments compliance between these two additional rolling bearings and the corresponding bearing surfaces of the members may be provided by utilizing an elastomeric material such as rubber for the outer surfaces of the rolling bearings. Various known bearing types may be used for any or all of the rolling bearings including ball, needle, or roller bearings, or more conventional sleeve bearings.

It is therefore a principal object of the present invention to provide a vertically adjustable table or work surface which can be raised and lowered automatically by an operator to an appropriate height with a precise degree of control and without binding, shake, or roughness in its motion.

It is another object of the present invention to provide a table or working surface with a powered lifting system which is convenient for handicapped workers to easily adjust the surface to their optimum work levels.

It is yet another object of the present invention to provide a maximum clear space under the work surface by positioning the supporting legs near the rear of the work surface.

It is another object of the present invention to provide a base which is angled at the rear such that the adjustable table may be positioned well back into a corner while providing maximum clear space under the front area of the work surface.

It is also on object of the invention to provide means whereby the telescoping legs may be mounted to a wall at the rear of the work surface.

It is a further object of the invention to provide a bearing system within the telescoping legs such that the work surface can move smoothly without shake or binding when the maximum working load is cantilevered in a position well forward of the axes of the telescoping legs.

Other objects, advantages, and features of the invention will become apparent from the following description and accompanying drawings, showing only a preferred embodiment of the invention.

DETAILED DESCRIPTION OF THE INVENTION

Figure 1:
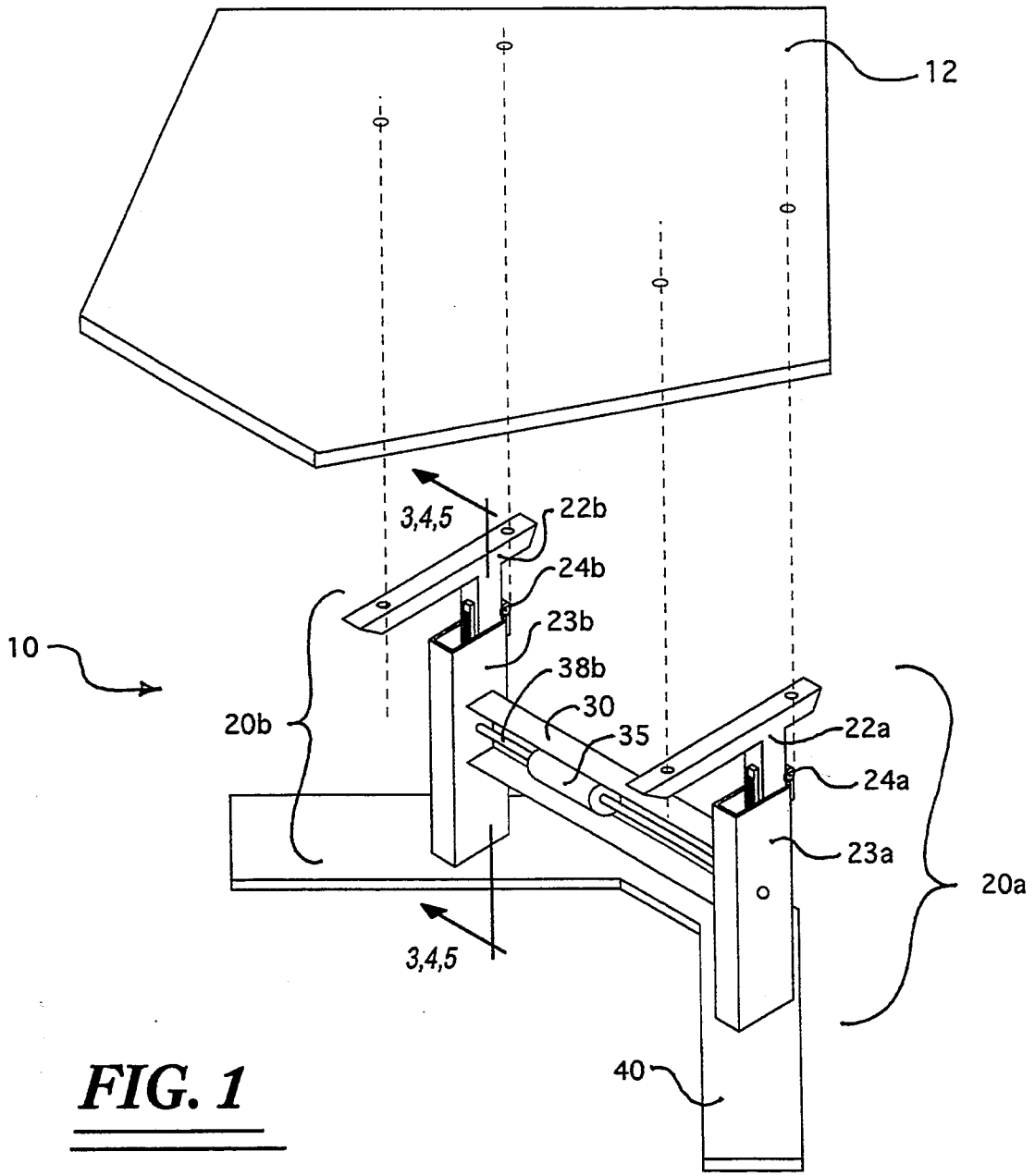
FIG. 1 is a schematic view of the apparatus of the present invention having a unified base with an angled back.

Referring now to the drawings in which like numbers represent like parts, FIG. 1 shows the adjustable work surface of the present invention, designated generally as 10, having a top 12 supported by a pair of telescoping leg assemblies 20a a and 20b which are attached to and supported by a base 40. Leg assemblies 20a and 20b comprise outer tubular members 23a and 23b enclosing interior rectangular spaces in which inner members 22a and 22b slide vertically. Rolling bearings 24a and 24b are mounted on the top rear of outer tubular members 23a and 23b such that they bear on the rear surfaces of inner members 22a and 22b. The outer tubular members 23a and 23b are rigidly joined by a horizontal beam 30 which runs between them, and on which a single common drive motor 35 is mounted. Drive shafts 38a and 38b are coupled from motor 35 to pinions 29 shown in FIG. 4 inside each leg 20a and 20b. In alternate embodiments beam 30 may be a channel or box beam which may be of a single rolled cross section, or assembled of plate and/or channel components. Motor 35 may be mounted to the exterior of the beam 30, or mounted inside the space enclosed within the beam section. Drive shafts 38a and 38b may be run exterior to the beam 30 or also inside the space enclosed within the beam.

Base 40 is a single L shaped unit having its apex at the rear and having an included angle in the range of 60 to 120 degrees opening toward the front of the adjustable work surface 10. Base 40 may also be arcuate, triangular, or otherwise formed to accomplish essentially the same function of fitting into a corner and maintaining an open space to the front. The unitized base 40 may be fabricated of a single piece of stock, or may be assembled of components by welding, bolting, or similar joining in the rear area near the apex, provided that the base 40 is sufficiently rigid to withstand the twisting moments created by a cantilevered load on top 12.

Figure 2:
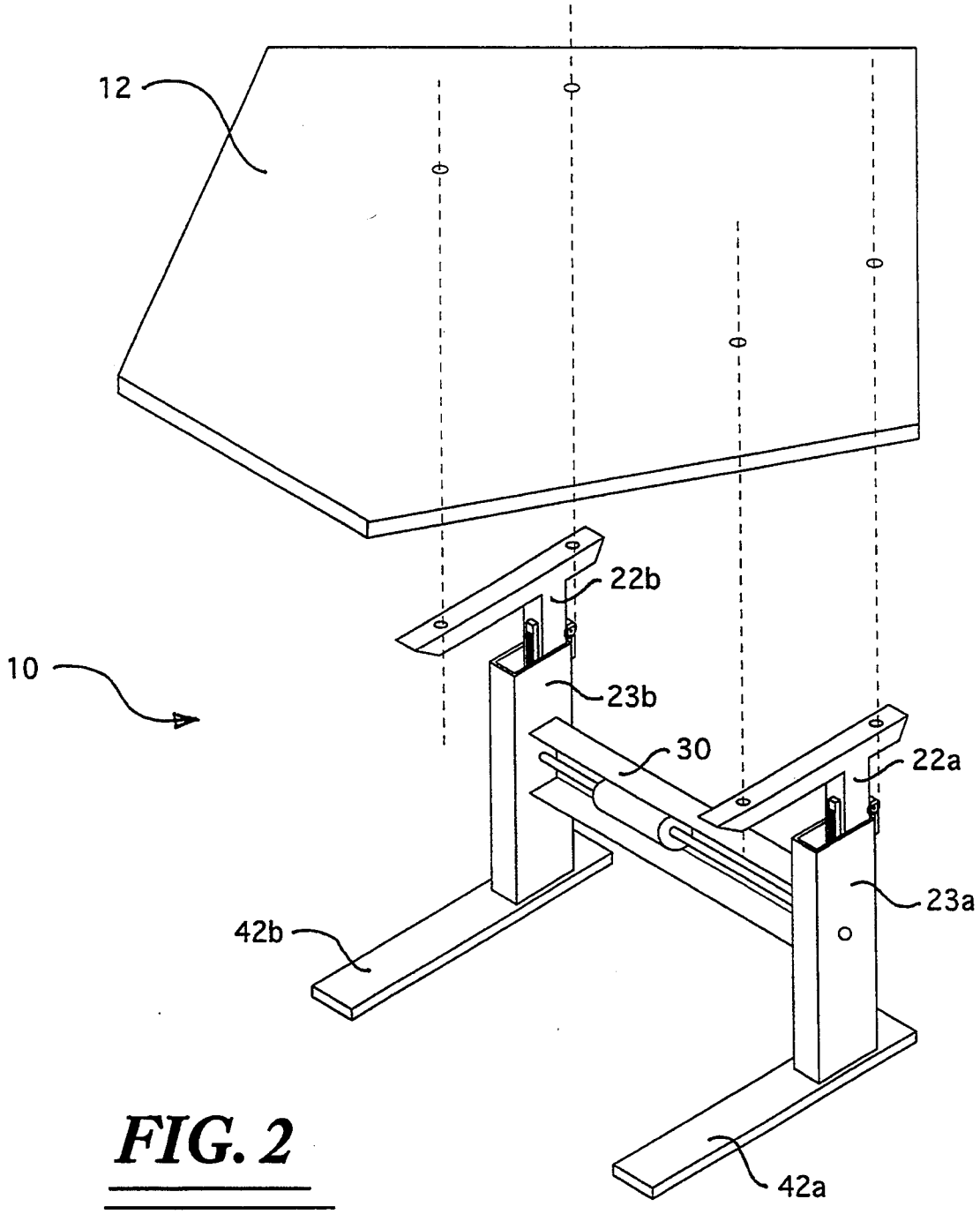
FIG. 2 is a similar view of the apparatus of the present invention having a base of separate parallel feet.

In FIG. 2 there is shown an alternate embodiment of the present invention having a base comprising a pair of separate feet 42a and 42b. These feet may be parallel and run in a direction perpendicular to beam 30, or they may also be spread toward the front at an angle similar to that between the elongated sides of base 40 in FIG. 1. However, when spread at such an angle, experience has shown that joining in the rear into a single rigid unit as shown in Fig. I is preferred to provide adequate torsional rigidity and stability under cantilevered loading near the front of top 12.

Figure 3:
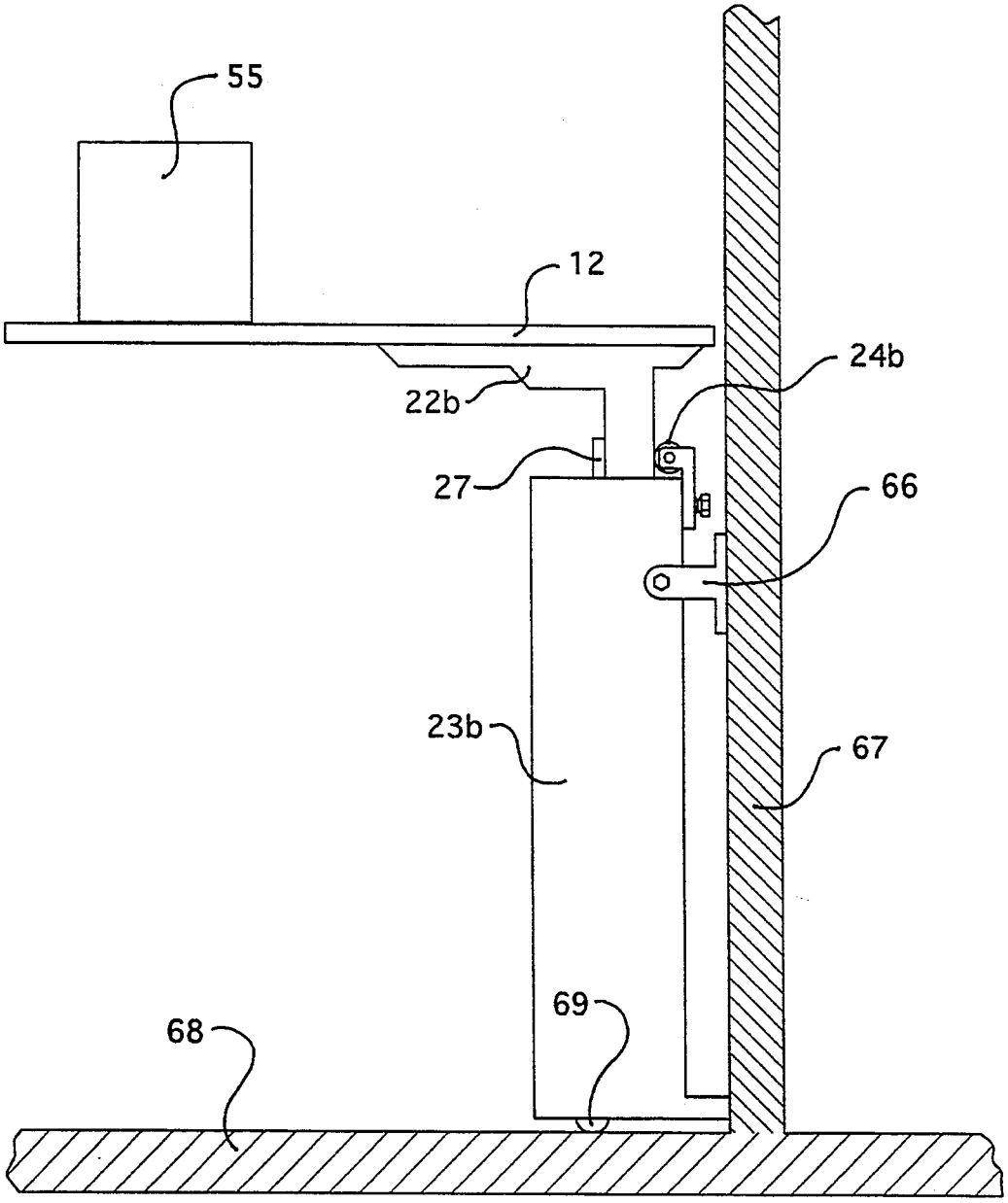
FIG. 3 is a view showing means for mounting the apparatus of the present invention to a wall.

In FIG. 3 is shown yet another embodiment of the present invention having means for mounting the telescoping legs on a building wall or furniture partition to the rear of the working surface. Here is shown a bracket 66 attached to the upper portion of outer member 23b. Bracket 66 is attached to a wall 67 by lag screws or the like having sufficient strength to support the force produced by a load 55. The vertical component of the force produced by load 55 is supported by a pad 69 resting on a floor 68.

Figure 4:
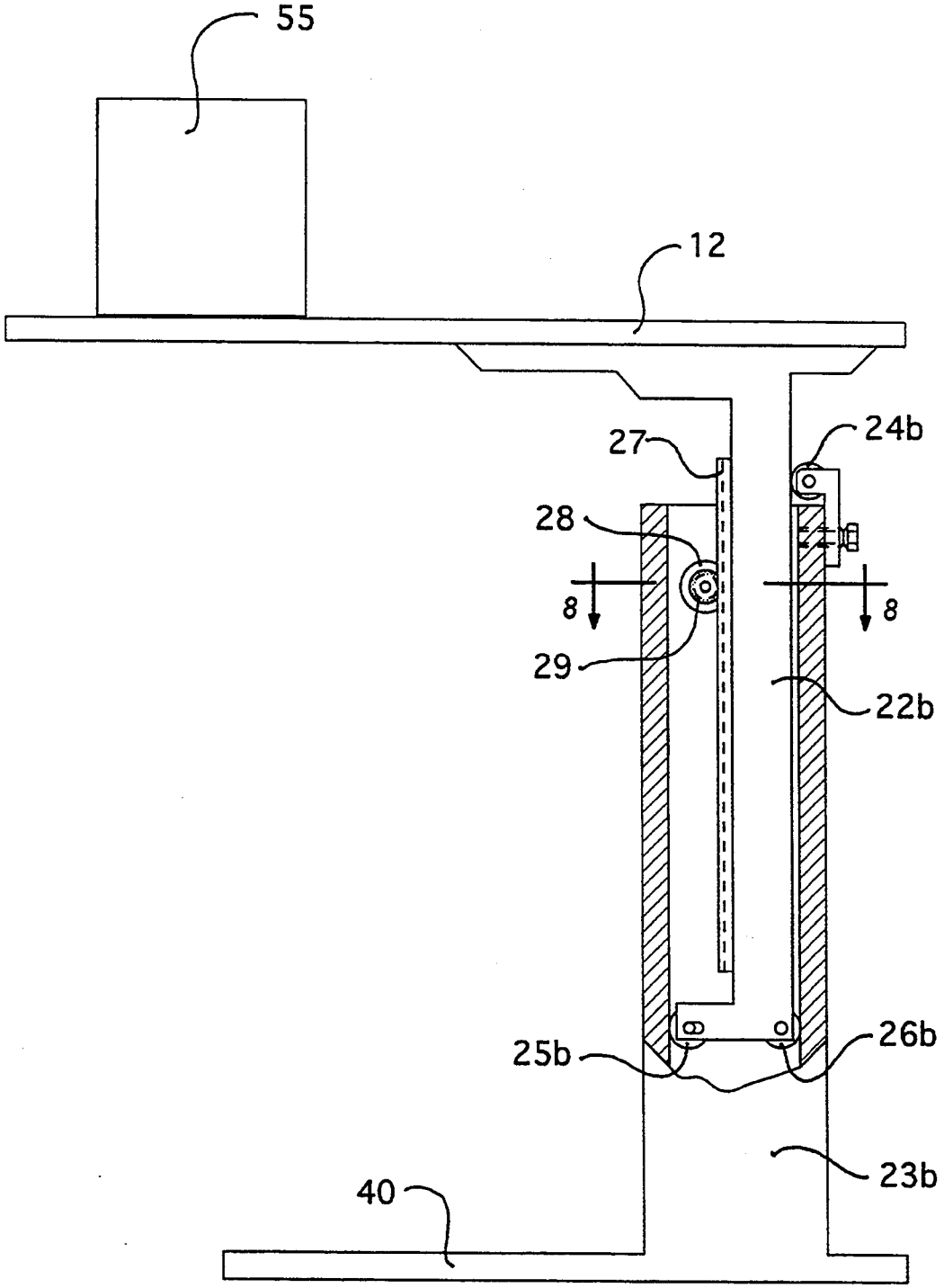
FIG. 4 is a partial sectional view of the inside of one telescoping leg.
Figure 5:
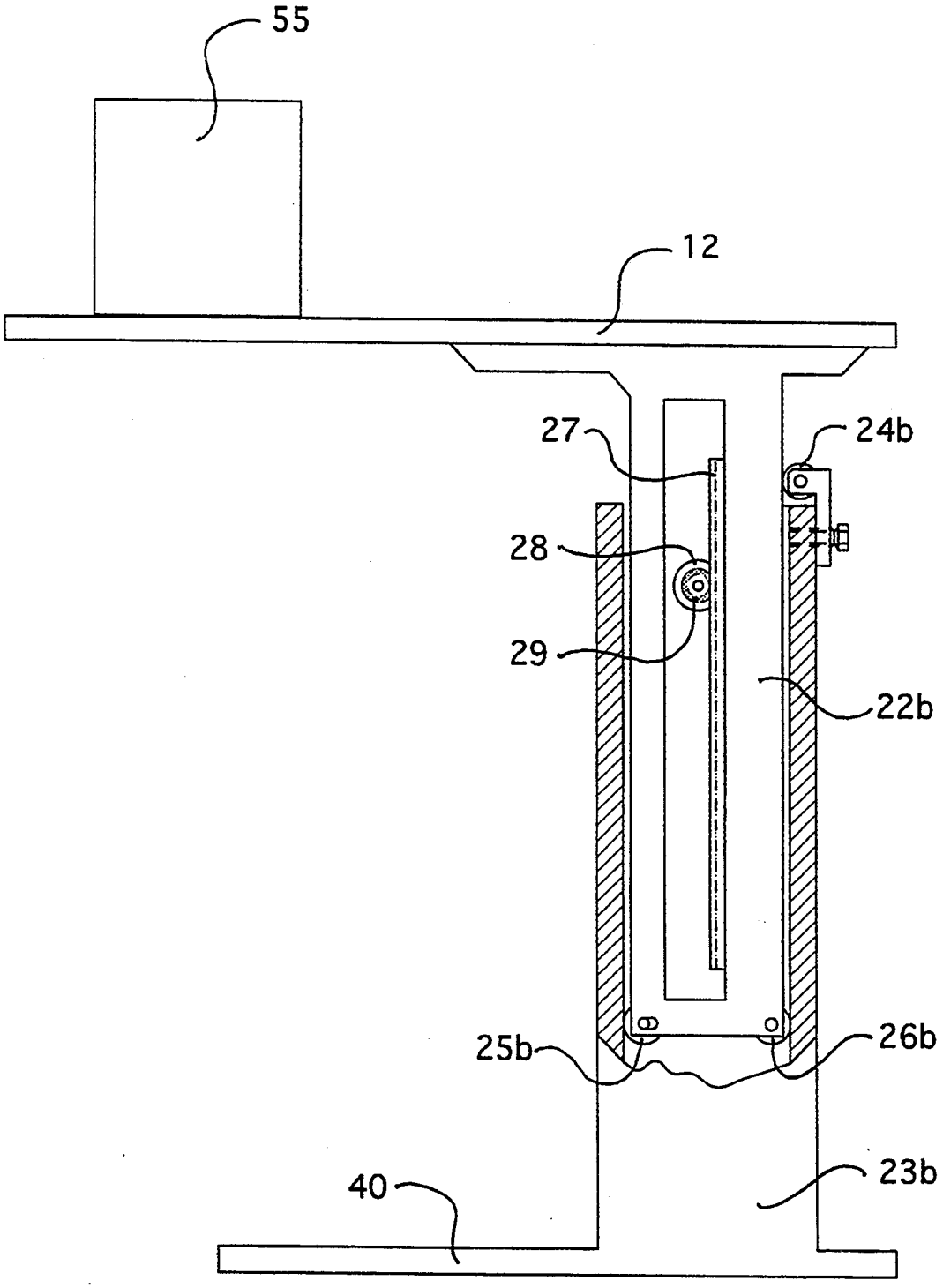
FIG. 5 is a view showing an alternate construction of the inner member.
Figure 6:
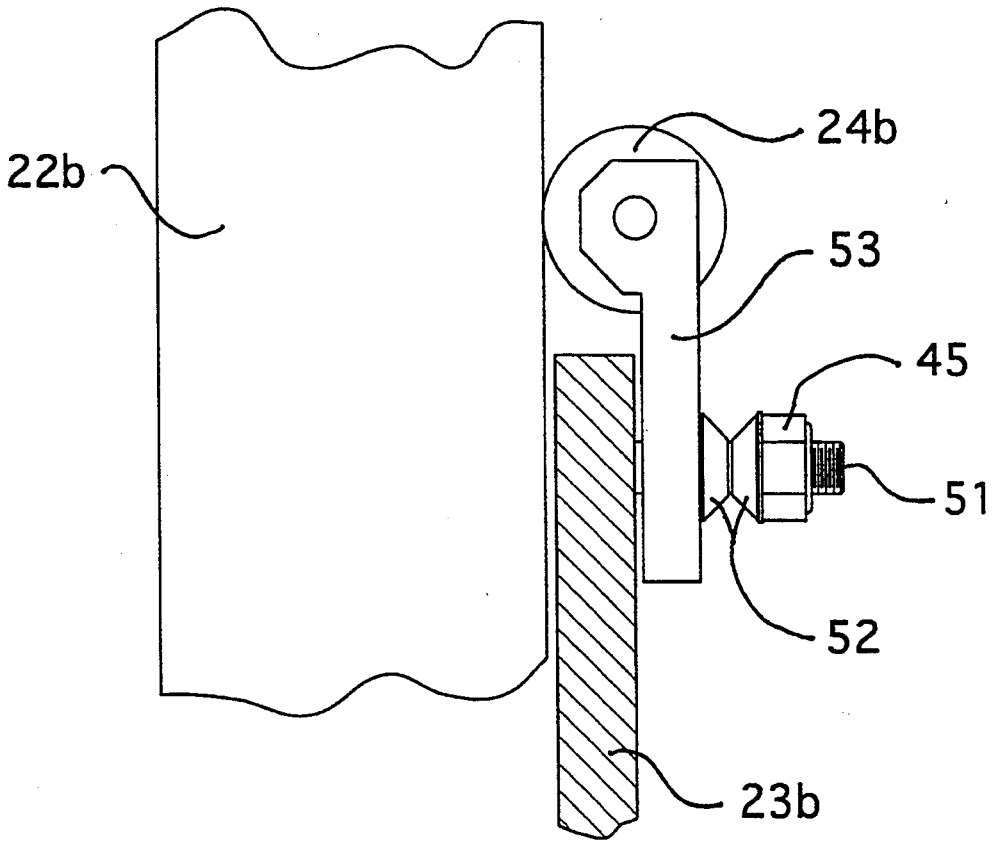
FIG. 6 is a detail view of the compliantly mounted top rolling bearing.
Figure 7:
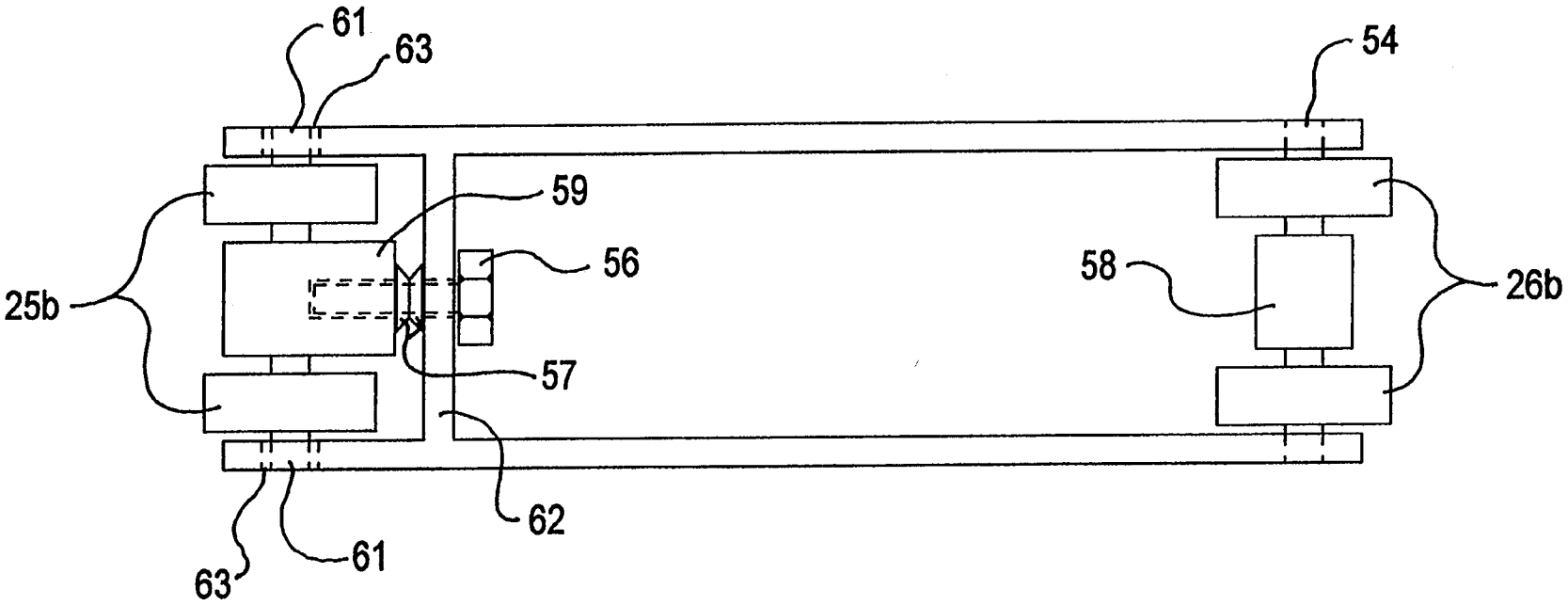
FIG. 7 is a bottom view of the inner member showing details of the lower rolling bearing.

Details of construction of one of the legs 20b are shown in FIG. 4. In FIG. 4 load 55 is shown bearing on the forward portion of top 12 which is attached to the upper end of inner member 22b. Inner member 22b is shown moving vertically within outer tubular member 23b which is supported on base 40. Rolling bearing 24b is shown mounted at the rear of member 23b, bearing on the rear surface of inner member 22b. In FIG. 6 it can be seen that rolling bearing 24b is mounted to outer member 23b by a self-locking nut 45 on a stud 51 through a mounting bracket 53. The nut 45 bears against Belleville spring washers 52 which in turn bear on bracket 53, thereby compliantly urging bearing 24b against the surface of inner member 22b. Nut 45 may be adjusted to compress spring washers 52 to a degree sufficient to always maintain clearance between the outer member 23b and inner member 22b under maximum cantilevered weight of lead 55 on top 12. A rolling bearing 26b is mounted an the lower rear corner of inner member 22b such that it bears on the inside of the rear wall of outer tubular member 23b, thereby preventing sliding contact between the rear surfaces of members 22b and 23b. FIG. 7 shows the preferred embodiment of rolling bearing 26b as a pair of ball bearings 26b separated by a spacer 58 mounted on a common shaft 54.

In preferred embodiments, a rolling bearing 25b is also compliantly mounted on the front lower corner of inner member 22b as shown in FIGS. 4 and 7. Bearing 25b comprises a pair of ball bearings separated by a threaded block 59 mounted on a common shaft 61. Common shaft 61 is fitted into elongated holes 63 in inner member 22b. Belleville spring washers 57 are mounted concentrically on an adjustment bolt 56, and urge block 59 forward. Block 59 in turn urges bearings 25b against the inner front wall of outer member 23b, thereby eliminating clearance and shake between the lower end of inner member 22b and outer member 23b. Prior to assembly, adjustment bolt 56 is advanced to draw block 59 and bearing 25b toward the rear of member 22b. After member 22b is inserted into outer tubular member 23b, bolt 56 is partially withdrawn to allow bearing 25b to be urged against outer member 23b by spring washers 57.

Figure 8:
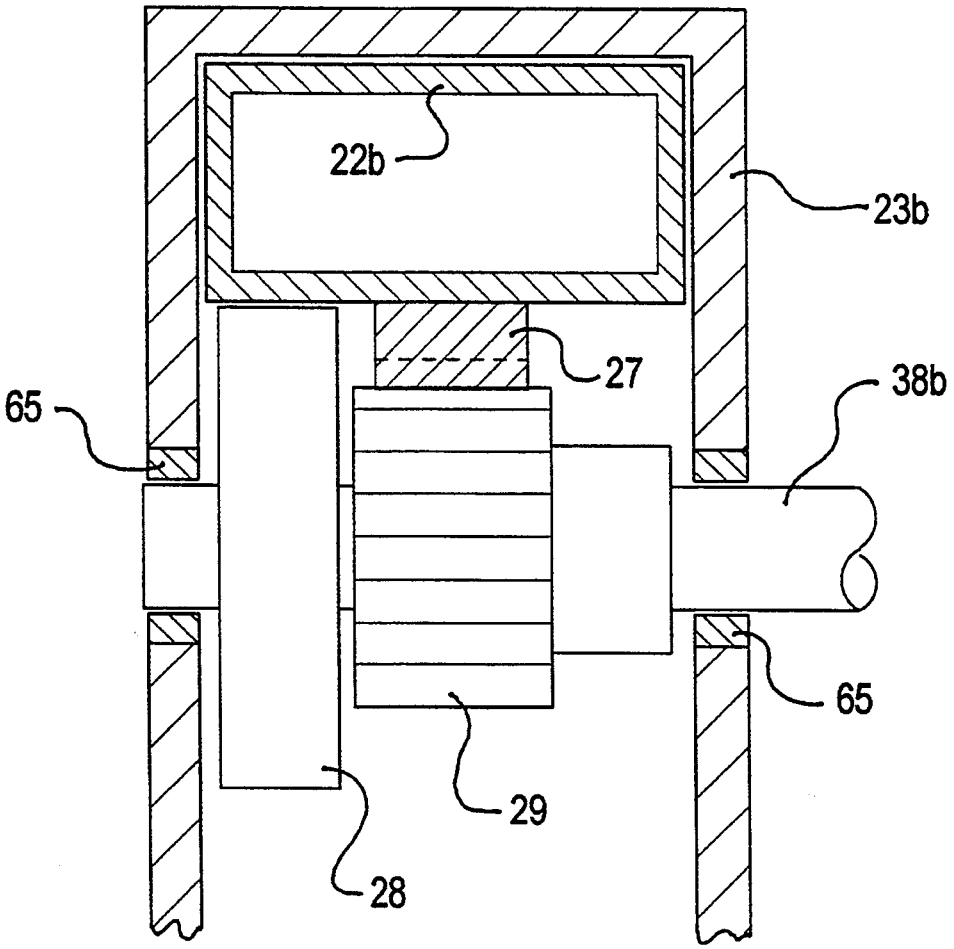
FIG. 8 is a sectional view of the rear portion of a telescoping leg showing the detail of the drive pinion, rack, and roller.

In FIGS. 4 and 8 pinion 29 is shown engaged in a rack 27 which is mounted on the front surface of inner member 22b. Pinion 29 is mounted on drive shaft 38b which is supported in outer tubular member 23b by a pair of bushings 65. Rolling bearing 28 is also mounted on shaft 38b adjacent to pinion 29. Rolling bearing 28 bears on the front surface of the rear column of inner member 22b adjacent to rack 27 so as to provide a horizontal force against the inner member and maintain a constant and proper depth of engagement of pinion 29 and rack 27 under all normal loads and positions. The construction of the other leg 20a is identical to that described above for leg 20b.

In operation a worker may energize drive motor 35 by means of a control circuit of known type. If given for example an upward command, motor 35 rotates drive shafts 38a and 38b which in turn rotate pinions 29. Pinions 29 are engaged in racks 27, and thereby drive inner members 22a and 22b upward at the same rate. Even with a substantial cantilevered load 55 on top 12, rolling bearings 28 and 26a and 26b support the load and maintain proper engagement of pinion 29 and rack 27, and bearings 24a, 24b, 25a, and 25b cooperate to maintain inner members 22a and 22b moving smoothly within members 23a and 23b without sliding contact. This results in uniform smooth motion of the top 12 without shake or binding even with a substantial cantilevered load as shown in the drawings.

I claim:

1. A vertically adjustable work surface comprising:

a) a top;

b) two vertically telescoping leg assemblies supporting said top, each comprising:

i) a vertically elongated inner member having an upper end attached to the underside of said top and a lower end opposite to said upper end;

ii) an outer tubular member having walls which enclose an interior space in which said inner member moves vertically and having an open upper end which receives said inner member and a lower end opposite said upper end;

iii) first rolling bearing means attached to the rear of the lower end of said inner member and urged into rolling contact against an inner wall of said outer tubular member, for supporting said inner member and preventing sliding contact between said lower end of said inner member and said outer tubular member under loading of said top;

iv) a rack attached to said inner member running in the direction of a longitudinal axis from the upper end to the lower end of said inner member;

v) a drive shaft rotatably supported on one or more of said walls of said outer tubular member;

vi) a drive pinion concentrically mounted to said drive shaft and engaging said rack;

vii) second rolling bearing means attached to said outer tubular member and running against a surface of said inner member, for limiting the maximum depth of engagement of said drive pinion into said rack and preventing binding and excess friction of the pinion and rack;

c) a horizontal beam rigidly attached to said leg assemblies adjacent to said drive shafts;

d) drive means for rotating said drive pinions mounted to said horizontal beam between said leg assemblies, said drive means rotatably connected to said drive shafts; and e) support means attached to said outer tubular members for rigidly supporting said telescoping leg assemblies vertically.

2. A work surface according to claim 1 wherein said drive means comprises an electric motor.

3. A work surface according to claim 1 wherein said second rolling bearing means are mounted on said drive shafts adjacent to said drive pinions and which run in rolling contact against a surface of said inner members adjacent to said racks.

4. A work surface according to claim 1 wherein each telescoping leg further comprises a third rolling bearing means which is attached to the rear of the upper end of said outer tubular member and is urged into rolling contact against said inner member, for preventing sliding contact between said inner member and upper end of said outer tubular member.

5. A work surface according to claim 4 wherein said third rolling bearing means is elastically and adjustably attached to said outer member in order to be compliantly urged into rolling contact with said inner member, thereby eliminating clearances and maintaining constant contact without binding while accommodating normal manufacturing variations of the members.

6. A work surface according to claim 4 wherein said third rolling bearing means is adjustably mounted to said outer member and has a compliant surface of an elastomeric material in order to be urged into rolling contact with said inner member, thereby eliminating clearances and maintaining constant contact without binding while accommodating normal manufacturing variations of the members.

7. A work surface according to claim 1 wherein each telescoping leg assembly further comprises a third rolling bearing means which is attached to the front of the lower end of said inner member and is urged into rolling contact against said outer tubular member, for preventing sliding contact between lower end of said inner member and said outer tubular member.

8. A work surface according to claim 7 wherein said third rolling bearing means is elastically and adjustably attached to said inner member in order to be compliantly urged into rolling contact with said outer member, thereby eliminating clearances and maintaining constant contact without binding while accommodating normal manufacturing variations of the members.

9. A work surface according to claim 7 wherein said third rolling bearing means is adjustably mounted to said outer member and has a compliant surface of an elastomeric material in order to be urged into rolling contact with said inner member, thereby eliminating clearances and maintaining constant contact without binding while accommodating normal manufacturing variations of the members.

10. A work surface according to claim 1 wherein said support means further comprises two elongated feet which are attached to the lower ends of said outer tubular members and which run on a floor in a direction such that the included angle between said elongated feet is in the range of 0 to 120 degrees.

11. A work surface according to claim 1 wherein said support means further comprises an approximately L-shaped foot attached to the lower ends of said outer tubular members, and having an apex at the rear of said work surface and an included angle in the range of 60 to 120 degrees opening to the front for installation of the work surface in a corner of a room to provide maximum clear floor space under the work surface.

12. A work surface according to claim 1 wherein said support means further comprises at least one mounting means attached to each of said outer members for attachment of said outer members to a wall.

* * * * *